US008150286B2

(12) United States Patent
Yacoub et al.

(10) Patent No.: US 8,150,286 B2
(45) **Date of Patent: *Apr. 3, 2012**

(54) APPARATUS AND METHODS FOR IMAGE AND PRINT BLANKET LIFE ENHANCEMENT

(75) Inventors: Naseem Yacoub, Rehovot (IL); Ilan Romem, Ramat Hasharon (IL); Gilad Tzori, Moshav Satariyya (IL); Clayton L. Holstun, San Marcos, CA (US); Vince Heesen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/015,340

(22) Filed: Jan. 27, 2011

(65) Prior Publication Data

US 2011/0158712 A1 Jun. 30, 2011

Related U.S. Application Data

(63) Continuation of application No. 11/996,946, filed on Sep. 18, 2008, now Pat. No. 7,937,010.

(51) Int. Cl.
*G03G 15/16* (2006.01)
*G03G 15/20* (2006.01)

(52) U.S. Cl. ..... 399/66; 399/308

(58) Field of Classification Search ..... 399/66, 399/82, 302, 308, 383, 384

See application file for complete search history.

(56) References Cited

U.S. PATENT DOCUMENTS

| | | | | |
|---|---|---|---|---|
| 5,973,721 | A | 10/1999 | Bergmans et al. | |
| 5,999,763 | A | 12/1999 | Hiroshima et al. | |
| 6,108,513 | A | 8/2000 | Landa et al. | |
| 6,263,174 | B1 | 7/2001 | Fuchiwaki et al. | |
| 6,970,675 | B1 | 11/2005 | Yoshino et al. | |
| 7,937,010 | B2 * | 5/2011 | Yacoub et al. | 399/66 |

FOREIGN PATENT DOCUMENTS

| | | |
|---|---|---|
| EP | 0727718 | 8/1996 |
| JP | 2002040741 | 2/2002 |

* cited by examiner

*Primary Examiner* — Sandra Brase

(57) ABSTRACT

Apparatus and methods for improving print quality and print blanket life in liquid electrostatic printing, for example, forming a first toner image on an image surface; first transferring the first image to an intermediate transfer member; then transferring of the first image from the intermediate transfer member to a final substrate; affixing the first image on the final substrate; rotating the first image to create a second image; and, repeating the method using the second image.

9 Claims, 4 Drawing Sheets

APPARATUS AND METHODS FOR IMAGE AND PRINT BLANKET LIFE ENHANCEMENT

CROSS-REFERENCE TO RELATED APPLICATIONS

This application is a continuation of the U.S. application Ser. No. 11/996,946, filed on Sep. 18, 2008 now U.S. Pat. No. 7,937,010, entitled "APPARATUS AND METHOD FOR IMAGE AND PRINT BLANKET LIFE ENHANCEMENT", by Yacoub et al., which is hereby incorporated by reference herein in its entirety.

FIELD OF THE INVENTION

The present invention relates to electro-statographic printing. For example, an apparatus to and methods are provided for changing an image in relation to a photoreceptor and/or print blanket during printing.

BACKGROUND OF THE INVENTION

In some electro-statographic printing techniques, the printing process begins with placing a uniform electrostatic charge on a photoreceptor and exposing the photoreceptor to a light and shadow image or to a scanning laser to dissipate the charge on the areas of the photoreceptor exposed to the light and developing to form a latent electrostatic image. The resultant latent image is developed by subjecting the latent image to a liquid toner comprising a carrier liquid and pigmented toner particles. These toner particles are generally comprised of a pigmented polymer. Generally, the development is carried out, at least partially, in the presence of an electric field, such that the toner particles are attracted either to the charged or discharged areas, depending on the charge of the particles and the direction and magnitude of the field.

This image may then be transferred to a substrate such as paper or plastic film, often via an intermediate transfer member ("ITM") which is typically covered with a replaceable print blanket. The transferred image may then be permanently affixed to the substrate by the application of pressure, heat, solvent, overcoating treatment or other affixing processes. In general, in the commercial process used by HP-Indigo, the ITM is heated to a temperature that causes the toner particles and residual carrier liquid to form a film in the printed areas which is transferred to the final substrate by heat and pressure. Fixing to the final substrate is part of the transfer process.

The use of ITMs, and ITMs including print blankets, is well known. One disadvantage of using print blankets in electro-static printing is called "gloss memory". Gloss memory is observed when the same image is repeatedly printed on the same area of a print blanket. After a certain number of print cycles, the number depending on variables such as the type of print blanket and toner, the gloss on the print blanket where the image was printed is different than on the areas where it wasn't. Gloss memory manifests itself in subsequent printings of different images by producing images that vary in gloss depending on the image which caused the gloss memory. Repetitive printing of the same image can also affect the optical density memory of the print blanket and/or photoreceptor and the effectiveness of transfer of small dots in images.

Various attempts have been made to solve the gloss memory failure of print blankets in electro-static printing. The attempts have included advances in techniques of printing as well as in the equipment and materials used. For example, a technique has been developed whereby a solid color page, sometimes referred to as a "sky shot" in the art, is printed after a to predetermined number of printings. The idea is that the comprehensive layer of toner that is deposited on the blanket acts as a cleanser, adhering to stray toner particles and other debris and carrying them along for affixation to a final substrate material, such as paper. A disadvantage of the technique, however, is that the sky shot wastes toner and substrate material.

Another attempted solution to the gloss memory problem derives from the blanket itself. Conceivably, a blanket could be developed which resists gloss memory altogether. However, in practice it has been found that a print blanket that is resistant enough to significantly reduce gloss memory becomes ill-suited for liquid electro-static printing. Another equipment innovation that has been developed for addressing the gloss memory problem involves the liquid toner formulations that are used. ElectroInk® 4.0, which was developed by HP-Indigo® and which is commercially available, is such a liquid toner. However, gloss memory, even when printing is carried out with the improved ElectroInk® toner formulations, is still a problem for the field.

SUMMARY OF THE INVENTION

An aspect of some exemplary embodiments of the invention relates to reducing degradation of a print blanket used in electro-statographic printing by changing an image location and/or orientation during the printing process on the print blanket.

In an exemplary embodiment of the invention, the print blanket is located on an intermediate transfer member. In some exemplary embodiments of the invention, the image is rotated 180° at some pre-determined frequency between prints. Optionally, the image is rotated 180° every other print. Optionally, the image is rotated at least once every 1000 prints. Optionally, the image is rotated at least once every 2000 prints. Optionally, images which are rotated are rotated again after affixation to a final substrate in order to harmonize the orientation of the printed output.

In some exemplary embodiments of the invention, the image location is moved in relation to the print blanket located on the intermediate transfer member. Optionally, the image location moves longitudinally along the length of the print blanket. Optionally, the image location moves laterally along the width of the print blanket. Optionally, the image location moves both longitudinally and laterally during the course of printing. In some exemplary embodiments of the invention, the final substrate onto which the image is to be transferred is moved commensurate with the movement of the image in order to maintain accurate blanket to final substrate image transfer. In some exemplary embodiments of the invention, image movement occurs at a predefined frequency. Optionally, the image is moved every other print. Optionally, the image is moved at least once every 500 prints. Optionally, the image is moved at least once every 1000 prints. Optionally, the image is moved variably depending on the total number of prints expected to be made. Optionally, the length of the print blanket is varied to assist the longitudinal shifting of the image location.

An aspect of some exemplary embodiments of the invention relates to providing a lateral shifting of a substrate or the use of a substrate larger than required for printing the image. Optionally, a substrate having a width commensurate with the print job is used, but the substrate is shifted laterally to allow for image formation, development and transfer over a lateral range. In an exemplary embodiment of the invention, use of a wider substrate allows for imaging on a larger surface area. This method is less useful in large scale printing, since finishing of the pages is more complicated.

Various movements of the print position can be applied to both sheet and web printing.

There is thus provided, in accordance with an exemplary embodiment of the invention, a method of electrostatic printing, comprising: forming a series of toner images on an image surface; serially transferring the images to an intermediate transfer member, ITM; then transferring the images from the intermediate transfer member to a series of substrates or to different positions on a web substrate; wherein at least some of the images are transferred to the ITM in different positions or orientations on the ITM. Optionally, at least some of the images are rotated compared to other images in the series. Optionally, the rotation is 180°. Optionally, the method further comprises selectively rotating the substrate after printing thereon to provide a common orientation to the series of printed images. Optionally, at least some of the images are transferred to the ITM in different positions. Optionally, the substrate is a web. In some exemplary embodiments of the invention, the images in different positions on the ITM are displaced in a process direction on the ITM. Optionally, the web is advanced or retarded prior to transfer of an image thereto to compensate for the displacement of the image on the ITM. Optionally, at least one of the series of substrates is positioned relative to the ITM at a different index position to compensate for the displacement of the images on the ITM. Optionally, the images in different positions on the ITM are displaced in a direction lateral from the process direction on the ITM. Optionally, the web is displaced laterally prior to transfer of an image thereto to compensate for the displacement of the image on the ITM. Optionally, the images are transferred to a series of sheet substrates. In some exemplary embodiments of the invention, the images in different positions on the ITM are displaced in a direction lateral from the process direction on the ITM. Optionally, the sheet substrate is displaced laterally prior to transfer of an to image thereto to compensate for the displacement of the image on the ITM. Optionally, the image is sheets are aligned with each other after printing. In some exemplary embodiments of the invention, the series of substrates are a series of sheets and wherein the images are transferred to the sheets in a same position on the sheets, even when the images are in different positions on the ITM. Optionally, the rotating or displacement is performed at a predetermined frequency. Optionally, the frequency is every other image. Optionally, the frequency is at least once every 500 images. Optionally, the frequency is at least once every 1000 images. In some exemplary embodiments of the invention, the toner comprises a carrier liquid that is absorbed by a surface of the ITM. Optionally, the amount of carrier liquid absorbed by the intermediate transfer member is different for image and background areas of the image.

There is thus provided in accordance with an exemplary embodiment of the invention, a printing apparatus comprising: a data source; a printing engine that receives data from the data source, the printing engine comprising; a first surface adapted to hold toner images; an intermediate transfer member that receives images from the first surface, a sheet or web substrate feed that feeds the substrate to the printing engine such that images based on data from the data source are transferred to the substrate from the intermediate transfer member; and a controller operative to rotate or shift the position of images in a series of images such that the images are transferred to the intermediate transfer member at different positions and/or orientations.

BRIEF DESCRIPTION OF THE DRAWINGS

Exemplary non-limiting embodiments of the invention are described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. The attached figures are.

DESCRIPTION OF EXEMPLARY EMBODIMENTS

The formation and development of latent images on the surface of photoconductive materials using liquid toner, the liquid electrostatic printing ("LEP") process, is well known. The basic process involves placing a uniform electrostatic charge on a photo imaging plate ("PIP") or photoreceptor, exposing the layer to a light and shadow image to dissipate the charge on the areas of the layer exposed to the light and developing the resultant latent image by depositing on the image, having a background portion at one potential and a "print" portion at another potential, a finely divided electroscopic material known in the art as "toner". The toner will normally be attracted to those areas of the layer which retain a charge, thereby forming a toner image corresponding to the latent electroscopic image. This image may then be transferred to a substrate such as paper, often via an intermediate transfer member ("ITM") which is typically covered with a replaceable printing blanket. The transferred image may then be permanently affixed to the substrate by the application of pressure, heat, solvent, overcoating treatment or other affixing processes.

Rotating Image 180°

As described above, repetitive printing of the same image at the same place on the print blanket may carry with it a number of drawbacks, including gloss memory, print blanket and/or PIP optical density memory, and/or small dot transfer memory. Rotating the image periodically, or between printing cycles, reduces the negative phenomena associated with high volume, repetitive printing.

Figure 1:
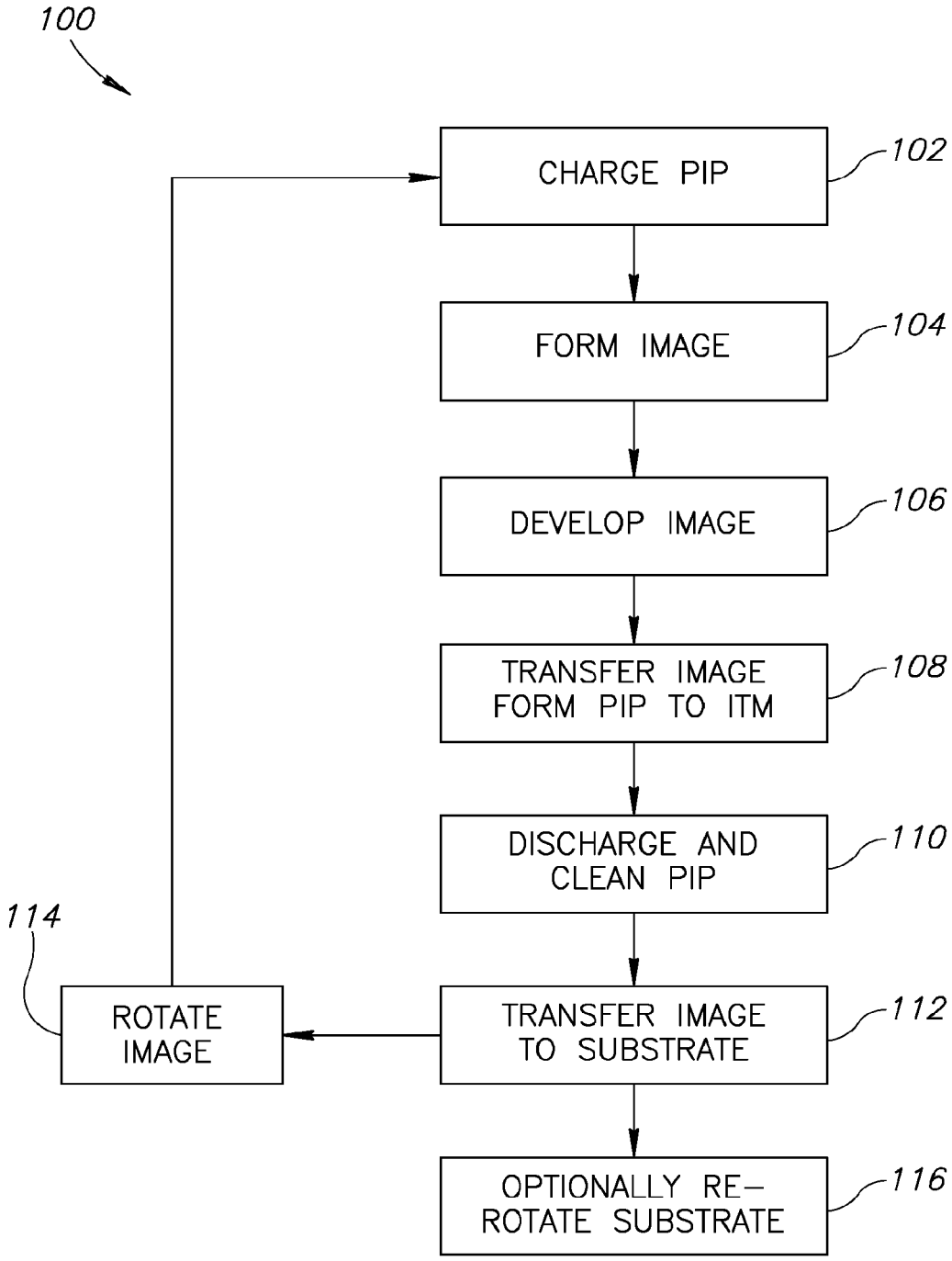
FIG. 1 is a flowchart depicting a method for image and print blanket life enhancement by rotating the image, in accordance with an exemplary embodiment of the invention.
Figure 2:
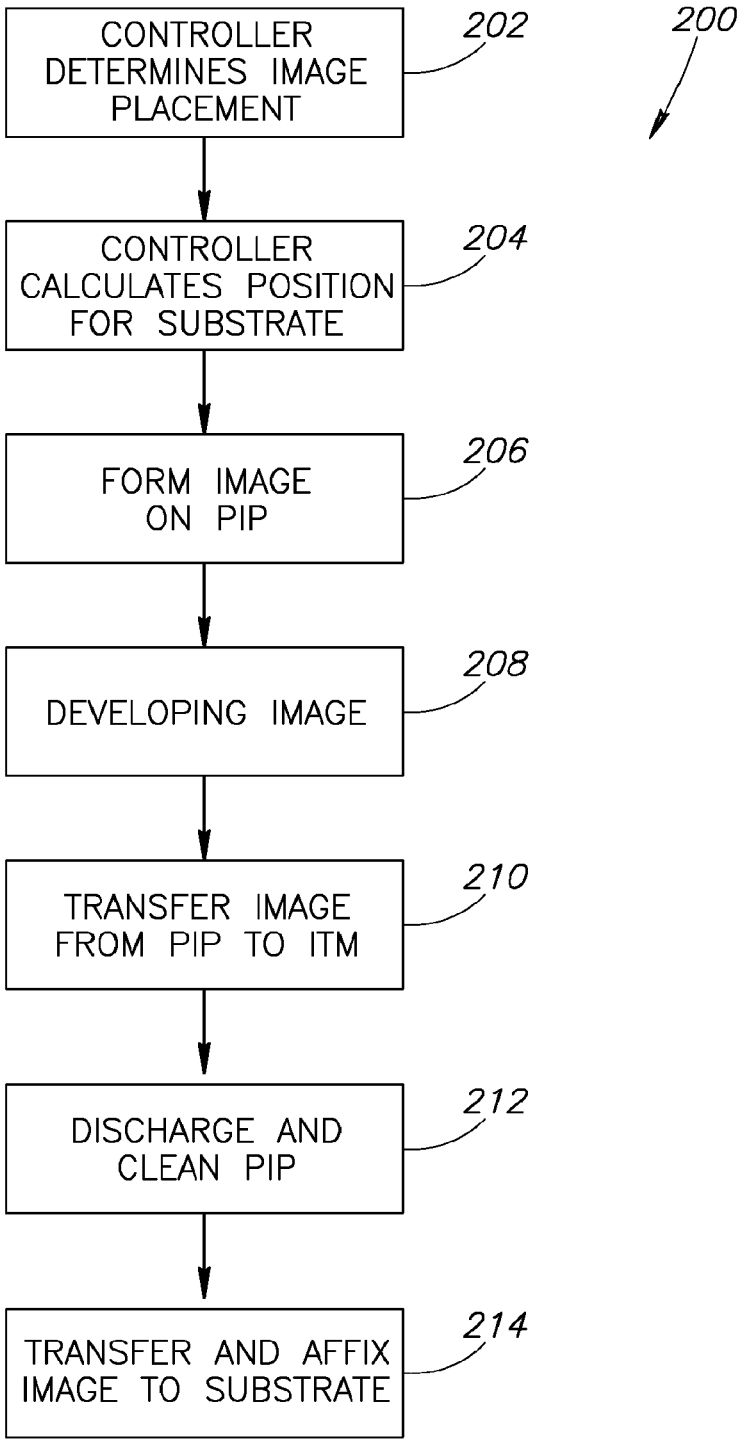
FIG. 2 is a flowchart depicting a method for image and print blanket life enhancement by moving the image location, in accordance with an exemplary embodiment of the invention.

Referring to FIG. 1, a flowchart (100) of a method of rotating an image is illustrated for diminishing these drawbacks, while improving image quality and print blanket life. In an exemplary embodiment of the invention, a PIP is charged (102) by at least one charging unit. A latent image which corresponds to an image which is to be printed by the printer is formed (104) by selectively discharging the charged PIP. The latent image is developed (106) by contacting the latent image with liquid toner comprising toner particles and carrier liquid. The toner image located on the PIP is then transferred (108) to an ITM. The PIP is optionally discharged and cleaned (110) by a cleaning/discharging unit prior to recharging of the PIP, in order to start another printing cycle. As the substrate passes by the ITM, the image located on the ITM is then transferred (112) to the substrate and fixed thereon. Prior to beginning this print cycle for another image transfer, a controller rotates the image 180° at a predetermined frequency (114), in an exemplary embodiment of the invention. The cycle is repeated, this time with the image rotated 180° in relation to the previous printed image. Optionally, the image is to rotated by controller every other print cycle. Optionally, the image is rotated at least once every 500 printings. Optionally, the image is rotated at least once every 1000 printings. Affixation of the image to the substrate is facilitated by applying pressure to the substrate by compressing it between an impression roller and the optionally heated ITM as the image is being transferred to the substrate. Eventually, the substrate bearing the image exits the printer. Optionally, the substrate is rotated (116) 180° so that all the sheets have a same desired orientation. In some exemplary embodiments of the invention, the printer is a sheet-fed printer. Optionally, the printer is a web-fed printer. When used with a web based printer the sheets cut from the web can be rotated during finishing. However, since this is a complex process, this method is useable mainly in sheet printing Movement of Image and Substrate Referring to FIG. 2, a flowchart (200) of an exemplary method of moving an image in relation to a print blanket is shown for reducing the negative effects of repetitive printing described above and improving image quality and print blanket life. Optionally, movement of the image occurs longitudinally in relation to the print blanket. Longitude is defined in this context as the longer axis of the print blanket (i.e., the print process direction). Optionally, movement of the image occurs laterally to the process direction. It should be noted that by moving the image in relation to the print blanket and/or photoreceptor, the impact of high volume, repetitive printing of the same image is reduced.

In an exemplary embodiment of the invention, a print cycle commences with a controller determining (202) a placement for the image to be printed on the print blanket. In some exemplary embodiments of the invention, the controller determines (202) an image displacement from a reference position that is at least slightly different than the placement of a previously printed image. Optionally, if an image being printed is the first printed image, the displacement is zero and the image is printed at the reference position. Optionally, determination (202) occurs at a predetermined frequency. Optionally, the image is moved every other print. Optionally, the image is moved at least once every 500 prints. Optionally, the image is moved at least once every 1000 prints. In an exemplary embodiment of the invention, controller then calculates (204) the proper location of a final substrate in order to provide accurate transfer of the image from an ITM to the substrate. In some exemplary embodiments of the invention, substrate is of the type used in a web-based printing press. Optionally, the web substrate is advanced and/or retarded by the printing press in order to properly position the substrate for accurately positioned image transfer. It is noted that if the web is properly to positioned for each image transfer the positions of the images on the web are regular, so that there are no complications in finishing.

In an exemplary mode of operation, the PIP is formed (206) with a latent image, which, when developed is to be eventually transferred to a final substrate. In subsequent printings, the controller ensures that the latent image is shifted slightly on the surface of the PIP. Thus, when the image is transferred from the PIP to the ITM, the image does not transfer to the exact same location on the print blanket on the ITM repetitively. The subsequent steps of printing, developing (208) the image, transferring (210) the image from the PIP to the ITM, discharging and cleaning (212) the PIP and transferring and affixing (214) the image to a final substrate are carried out to produce a printed image. Optionally, at least one of the preceding steps is not carried out.

In some exemplary embodiments of the invention, the image is placed at the exact same position on the PIP every time (as opposed to slightly shifted on the PIP as above), but the PIP engages the ITM drum at varying index points. Optionally, the drums are disengaged to do this. The first exemplary embodiment has the advantage of spreading wear out on the PIP, but has the disadvantage of requiring a longer PIP. The second exemplary embodiment does not necessarily improve PIP wear, but the PIP itself is optionally shorter It is relatively simple, in most printers, to effect lateral movement of a sheet between prints. In general, in sheet printers the sheet is laterally positioned against a side guide before entering the printing engine. In an embodiment of the invention, the position of the side guide is changed in conjunction with the changes in position of the image on the PIP/ITM so that the images are positioned in the same place on the sheet. After printing the sheets are realigned before or during finishing.

Lateral adjustment of a web position is also possible and can be used to effect movement of the image on the PIP/ITM while keeping the position of the image on the web in a standard reference position.

Longitudinal adjustments are possible in some exemplary embodiments of the invention by utilizing null, or partial null, cycles. Briefly, a null cycle is operation of a printing apparatus as if normal printing is being performed; however, there is no transfer or development of any image. A substantial portion of the printing in this method is similar to the methods above. However, upon the transfer of the image to a final substrate, rather than commencing a new print cycle, at least a partial null cycle is commenced in between print cycles. The partial null to cycle allows the less-than-complete rotation of the PIP and the ITM prior to receiving another image. In this manner, the next image that is developed on the PIP, and subsequently transferred to the ITM, is offset in relation to the image that preceded it. Optionally, the null cycle is greater than one complete cycle. Optionally, a partial null cycle is added at predetermined intervals. For example, a partial null cycle is optionally used every other printing. Optionally, a partial null cycle is used at least every 500 printings. Optionally, a partial null cycle is used at least every 1000 printings.

In some exemplary embodiments of the invention, a longer print blanket is used to provide more flexibility in image shifting. A longer blanket allows the optional alteration of the points at which the PIP engages to the blanket. In some exemplary embodiments of the invention, this affords movement of the image in the longitudinal direction. Optionally, the impression drum (to which the paper is attached) engages with the ITM at a later point in time, to compensate for longitudinal movement of the image. Optionally, a longer print blanket is used in either a sheet or a web press.

Figure 3A:
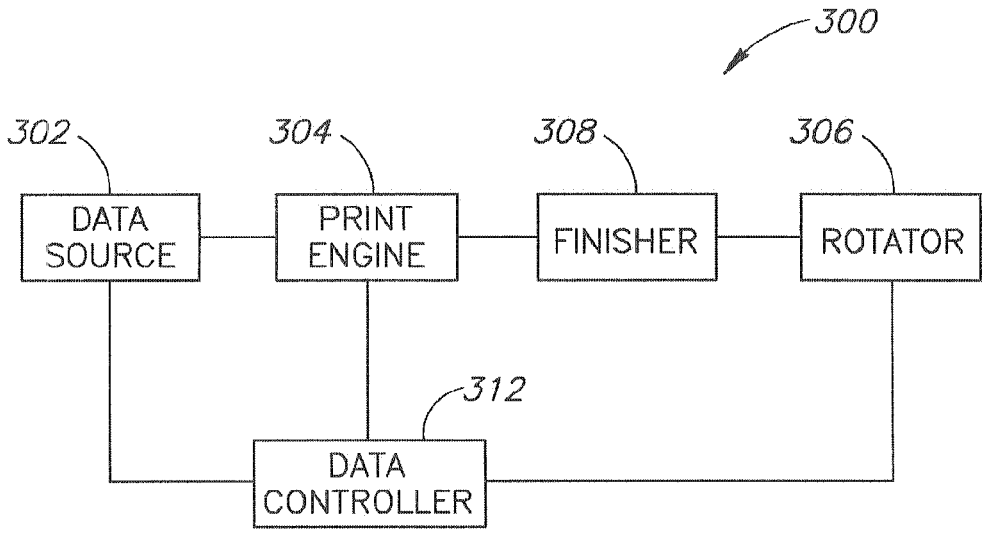
FIGS. 3A-C are schematic block diagrams depicting the general operational relationship of various components, in accordance with an exemplary embodiment of the invention.

FIG. 3A is a simplified block diagram of an exemplary system of printing 300 in which the image is periodically rotated by 180 degrees. System 300 comprises a data source 302, a data controller 312, a printing engine 304 and an optional sheet rotator 306. When printed, sheet is either delivered to a finisher 308 or, when two sided printing is desired, is delivered to a second printing engine or returned to engine 304 after inversion (not shown).

Periodically, as described above, data controller 312 rotates the data for printing on the engine so that the image on a sheet is rotated by 180 degrees. At the same time, data controller 312 signals the sheet rotator to rotate the sheet on which the rotated image has been printed so that the second rotation (of the sheet) returns the direction of the image on the sheet leaving the rotator to a standard direction. In general, sheet rotator 306 can be any sheet rotator as known in the art, which can selectively rotate a sheet by 180 degrees or pass a sheet unrotated. Thus, while the image on the ITM is rotated, at least partially ameliorating the image memory problem, the sheets leaving printer 300 are always facing in the same direction.

Figure 3B:
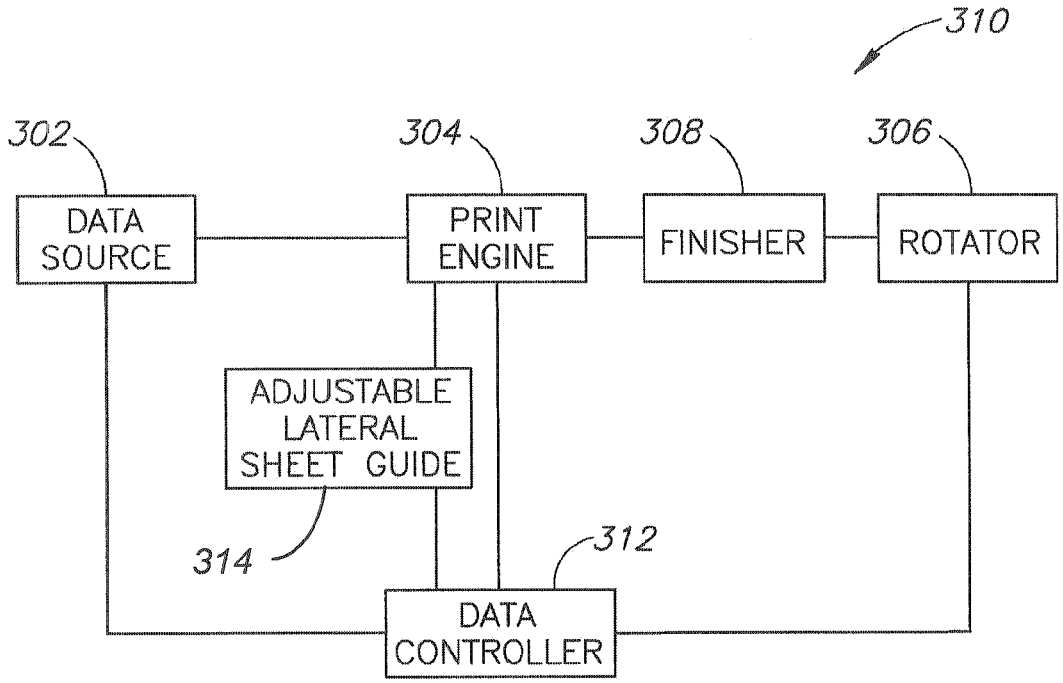

FIG. 3B is a simplified block diagram of an exemplary sheet printing system 310 in which images are periodically moved laterally on the ITM. System 310 comprises data source 302, a controller 312, an adjustable lateral sheet guide 314, printing engine 304 and finisher 308.

Periodically, as described above, controller 312 adjusts the lateral position of the data from data source 302 so that an image on the PIP/ITM is moved laterally from a reference to position. Controller 312 also signals adjustable lateral sheet guide 314 to change the alignment of sheets being printed to compensate for the lateral image motion. Thus, the image is printed on the same position on the sheet as when both the image and the adjustable lateral sheet guide 314 are in their reference positions. After the laterally displaced sheet is discharged from the printing engine it is fed to finisher 308. Optionally, the lateral offset of the sheet is corrected prior to feeding to the finisher (not shown) or with an alignment mechanism in the finisher itself.

Figure 3C:
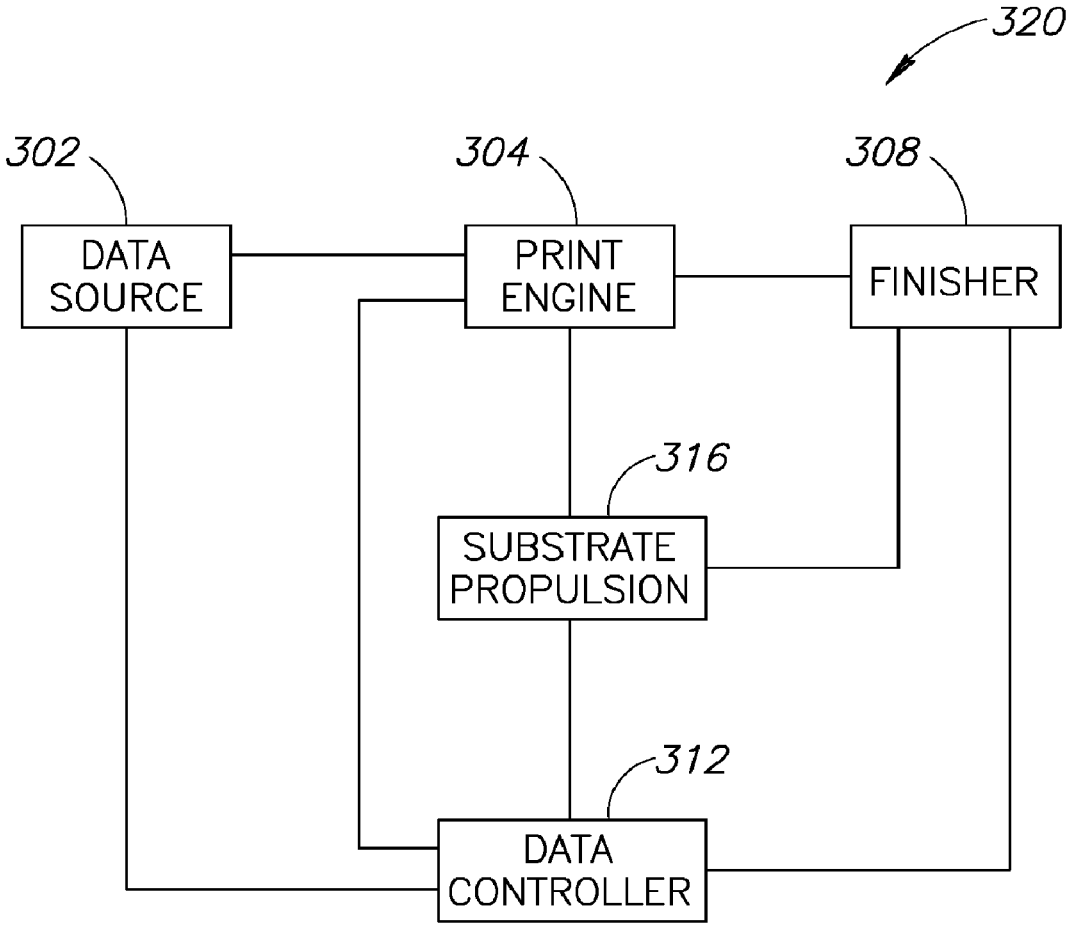

FIG. 3C is a simplified block diagram of an exemplary web printing system 320 for periodically shifting an image longitudinally on the ITM. System 320 comprises data source 302, controller 312, printing engine 304, substrate propulsion 316 and finisher 308.

Periodically, as described above, controller 312 adjusts the longitudinal position of the data from data source 302. Optionally, image to be printed is moved in the process direction up to a distance that depends on the length of the image and the length of the intermediate transfer member. Generally, the useful length on the intermediate transfer member should be longer than the length of the image being printed. Controller 302 also signals substrate propulsion system 316 (which is the same system that is normally used to position, and where necessary reposition, the web for receiving printed images from the ITM) to modify the advancement of the substrate through the system in order to compensate for the longitudinal image motion. Thus, the image is printed on the same position on the sheet independent of where it is printed on the PIP/ITM. After the longitudinally displaced sheet is discharged from the printing engine it is fed to finisher 308.

Some of the methods described above and below require that the sheets and or web be differently positioned during different print cycles, usually a mechanical adjustment in the equipment is necessary. This is true for example for lateral sheet and web motion. One possible way to effect this motion is to make very small incremental changes between prints. In many cases small increments can be made without reducing the printing throughput.

For lateral sheet changes, when multicolor images are being printed, four or more separations are printed for each sheet feed. Small or even moderate lateral repositioning of the sheet positioning occurs in between sets of separations. Optionally, a null cycle in which no printing takes place is inserted to allow for movement of the sheet alignment systems.

For longitudinal web repositioning, the change in position can be carried out on the fly, since repositioning of the web is part of the standard movements of the printing process.

For the method in which the image is rotated, no mechanical motion (except for the sheet rotator) is necessary and continuous printing is possible.

Lateral offset of images is somewhat more complex. In general, web feeders are equipped with adjustment mechanisms for hand adjustment of the lateral position of the web. In an embodiment of the invention, this mechanism is fitted with a motor control and the lateral position is either calibrated (open loop control) or sensed (closed-loop control). In either case, this allows for the movement of the sheets during a print run to allow for coordinated lateral motion of the web and image, such that the image is printed in the same lateral position independent of the lateral position of the image on the ITM.

A simplified block diagram of an exemplary system for lateral shift web based printing is the same as that shown in FIG. 3C, except that the substrate propulsion system includes a motorized lateral position control system, as described generally in the previous paragraph. In this system the data from data source 302 is displaced laterally so that its position on the PIP and ITM are laterally shifted. Data controller 312 also signals substrate propagation system 316 to shift the web sideways to compensate for the shift in the image, so that all images are printed at a same lateral position on the web. As in FIG. 3C the printed web is sent to the finisher after printing.

For lateral offset of the sheet, there may be timing problems, due to the relatively slower speed of the lateral motion. For print systems in which all of the color separations are first transferred to the ITM and then transferred as a group to the web, the time during which the separations are accumulating on the ITM should be sufficient to perform the lateral motion. For systems in which each color separation is transferred separately to the web, the printing "dead" time for the lateral motion is much reduced and it may be necessary to introduce one or more null cycles between completed printed images, during which the web is moved laterally.

It should be understood that while the invention has been described in terms of a single direction of motion, in an exemplary embodiment of the invention, both longitudinal and lateral motion is possible, as well as rotation.

In general, it should be understood that the present invention contemplates using nearly any available digital printing system in which additional lateral or longitudinal offset capability is provided. Thus, the details of actual systems used to carry out the invention may differ from even the very generalized structures shown in FIGS. 3A-3C.

In an exemplary embodiment of the invention, use of a wider substrate allows for imaging on a larger surface area. If a substrate larger than the image being printed is used, then to the image can be moved on the ITM without any changes in the mechanics of the printer. This method may be less useful in large scale printing, since finishing of the pages is more complicated.

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

The invention claimed is:

1. A method of electrostatic printing, comprising:

forming a series of toner images on an image surface, wherein at least some of the images are rotated on the image surface compared to other images in the series;

serially transferring each image in the series, after formation, to an intermediate transfer member, ITM;

transferring said each image from said ITM to a sheet of print medium; and after the transferring, rotating ones of the sheets that have the rotated images thereon so as to provide a common orientation to the images on the series of printed sheets.

2. A method according to claim 1, wherein said rotation is 180°.

3. A method according to claim 1, wherein the rotating includes automatically rotating the ones of the sheets that have the rotated images, responsive to automatically determining that the corresponding toner images are rotated on the image surface.

4. A method of electrostatic printing, comprising:

forming a series of toner images on an image surface;

serially transferring each image in the series, after formation, from the image surface to an intermediate transfer member, ITM, wherein at least some different images in the series of toner images are transferred to different positions on the ITM; and transferring each image from said ITM to a substrate;

wherein the images in different positions on the ITM are displaced on the ITM in a direction lateral from a process direction.

5. A method according to claim 4 wherein the images are transferred from said ITM to a series of sheet substrates.

6. A method according to claim 4 wherein the at least some different images in the series of toner images are formed in different positions on the image surface.

7. A method according to claim 4 wherein the at least some different images in the series of toner images are formed in a same position on the image surface.

8. A method according to claim 7 wherein the image surface engages the ITM at different positions during the serial transferring.

9. A method according to claim 4 wherein the images in different positions on the ITM are not displaced on the substrate in the direction lateral from the process direction.

* * * * *